United States Patent [19]

Lietzau

[11] Patent Number: 4,573,593

[45] Date of Patent: Mar. 4, 1986

[54] TOWER CRANE WITH HAMMER HEAD ADAPTATION

[75] Inventor: Joachim Lietzau, Duesseldorf, Fed. Rep. of Germany

[73] Assignee: Mannesmann AG, Duesseldorf, Fed. Rep. of Germany

[21] Appl. No.: 668,734

[22] Filed: Oct. 6, 1984

[30] Foreign Application Priority Data

Nov. 11, 1983 [DE] Fed. Rep. of Germany ..... 3340845

[51] Int. Cl.[4] ..... B66C 23/64

[52] U.S. Cl. ..... 212/239; 212/262; 212/266

[58] Field of Search ..... 212/183–185, 212/271, 266, 239, 262

[56] References Cited

U.S. PATENT DOCUMENTS

| | | | |
|---|---|---|---|
| 3,198,345 | 8/1965 | Brekelbaum et al. | 212/183 |
| 3,572,517 | 3/1971 | Liebherr | 212/184 |
| 3,804,264 | 4/1974 | Hedeen et al. | 212/183 |

FOREIGN PATENT DOCUMENTS

| | | | |
|---|---|---|---|
| 203365 | 7/1965 | Sweden | 212/184 |
| 971103 | 9/1964 | United Kingdom | 212/184 |
| 189994 | 3/1965 | U.S.S.R. | 212/184 |
| 1025657 | 6/1983 | U.S.S.R. | 212/183 |

*Primary Examiner*—Trygve M. Blix
*Assistant Examiner*—Stephen P. Avila
*Attorney, Agent, or Firm*—Ralf H. Siegemund

[57] ABSTRACT

A flat box is interposed between the pulley carrying head and the top element of the main boom of a tower crane, with traverses being exchangeably hinged to the box, the traverses being tensioned against the head and respectively carry a load cable guiding sheave and a holding cable attachment for the boom.

6 Claims, 5 Drawing Figures

TOWER CRANE WITH HAMMER HEAD ADAPTATION

BACKGROUND OF THE INVENTION

The present invention relates to a lattice tower crane having a main boom which is partitioned into separable elements of lattice construction, and having in addition a head part which is (or could be) secured to the tip of the main boom, the head is expepcted to have at least one pulley or sheave for guiding the lifting cable.

Cranes of the type mentioned above are known, but it has to be observed that in case of lifting bulky loads under a condition in which the main boom has an oblique orientation, the load when suspended from the cables must not hit the boom. This condition can be observed for a given lift height of the load, for example, through appropriately extending the main boom. But of course due to the lever effect, such extension of the main boom is a very costly aspect, and any particular assembly or disassembly is cumbersome and expensive. Moreover, for a given system the supportability of the crane is rendered more limited.

German printed patent application No. 2,807,415 suggests to attach an angled supplemental boom to the tip of the principal or main boom. This supplemental boom does in fact displace the first deflection pulley or sheave for the load carrying cable from the axis of the principal boom, using the load as point of reference. This way even bulky loads can be lifted, even if the main boom is relatively short, but the configuration of the supplemental boom makes sure that even a bulky load will not hit the main boom. However, there is an inherent disadvantage in that the load carrying capability of the supplemental boom reduces the capability of the crane as a whole, unless of course, under very extensive expanditure, the supplemental boom is further reinforced over and beyond the particular configuration as shown in this printed patent application. Also, of course, the assembly procedure is a costly and time consuming aspect of this approach.

For many years it is known to provide the tip of the principal boom with a so-called hammer head serving the same purpose, and, quite analogous to the aforementioned supplemental boom, effectively displaces the first deflection sheave or pulley for the cable from the axis of the principal or main boom. Also, a hammer head will normally reduce the load carrying capability of the crane to a lesser extent than a supplemental boom, as mentioned above. The known hammer heads, however, require a very extensive assembly procedure, and of course the principal boom must be equipped right from the beginning with suitable attachment equipment to which the hammer head can be connected and secured. This of course poses particular problems in the case if such a hammer head is to be attached to the main boom of a crane when this crane was not originally designed for such attaching operation. In this case then one really has to provide constructive modifications of the main boom which is actually quite undesirable in principle. Moreover, the known hammer heads of the type having a high load carrying capability are quite bulky, which means that storage and transport to the respective construction site requires a very large volume in terms of transport and storage capacity. Thus the hammer head is not only expensive to be constructed, but its very use is an expensive procedure and undertaking.

DESCRIPTION OF THE INVENTION

It is an object of the present invention to provide a new and improved lattice tower crane which, in a simple manner and for an individual case, can be adapted to lift bulky loads without extending the main boom, but without endangering the main boom by the load. The load carrying capability of the crane should be interfered with and particularly reduced to as small an extent as possible, and the inventive aspects should be applicable to already existing cranes without requiring their reconstruction.

It is another object of the present invention to provide a new and improved hammer head for use with tower cranes.

It is a specific object of the present invention to provide a new and improved lattice type tower crane having a main boom composed of a separable lattice elements including a tip element and a head to which is secured at least one deflection sheave or pulley for the load carrying cable.

In accordance with the preferred embodiment of the present invention, it is suggested to provide between the tip element and the main boom head an intermediate element being of flat, boxlike construction with a high degree of stiffness, and having fastening elements. The intermediate piece, box or element has a cross section which essentially corresponds to the cross section of the tip element, and the fastening elements of the intermediate piece where attached to the tip element corresponds to fastening elements of the main boom head, and where attached to the main boom head the fastening elements correspond to those of the tip element. Moreover, the front side of the main boom is provided with a first traverse, and the rear side with another traverse, respectively, pivotable about axes oriented perpendicularly to the principal axis of the boom. These traverses are hinged to the aforementioned intermediate piece, and they are tensioned in a releasable fashion to the main boom head. The angle between the two traverses on one hand, and the longitudinal axis of the main boom on the other hand are approximately 90 degrees; the front or unhinged end of the first-mentioned traverse is provided with a deflection pulley or sheave for the lifting cable, while the front or unhinged end of the other traverse is provided for connection to holding and tensioning cable of the principal boom. The two traverses are preferably of a planar lattice construction, and through pins or bolts they are pivotally or hingeddly connected to the intermediate element or box. Moreover, they are tensioned through tensioning rods connected to the head of the main boom. Preferably, the traverses are differently long, and the pin or bolt connection for the two traverses are similarly dimensioned so that they can be exchanged on the box. The deflection sheave on the first-mentioned traverse, and the articulation for the tensioning cable at the other traverse, are preferably connected under observation of similar dimensions, so that they, too, can be exchanged. The aforementioned tension rods should be adjustable in length direction.

The invention is based on the proposition that basically a hammer head is a good solution for the stated problem, but contrary to the known solutions a new type of hammer head is to be constructed which is easily assembleable and connectable and does not require that any existing tower cranes have to be structurally or constructively modified for purposes of adaptation, particularly for purposes of reacting the additional forces from the hammer head into the upper part of the main boom. This is the principal function of the intermediate piece which is arranged between the head of the main boom and the tip element thereof. The high stiffness of a flat, boxlike construction is amenable to fulfill this function. The intermediate piece or box (adapter) may be made of sheet or plate stock made of steel or of steel tubes. The box has a cross section, as stated, which corresponds to the cross section of the tip element. The principal elements (traverses) for the new hammer head are pivotable on this intermediate box or piece about axes which are respectively perpendicular to the axis of the main boom. This arrangement, together with a pin connection, permits indeed taking up of any forces that are reacted into the hammer head.

A universal or general type of name head should be provided so that it can be used in cranes particularly of the type which had not been constructed specifically for accepting a hammer head. This purpose can be fulfilled by providing, as stated, corresponding fastening elements for cooperation with the tip element and the head of the main boom. Normally, the latter are interconnected directly. The inventive box-like adapter is now interposed and matching fasteners and cross sections are the operative features. This way it is quite simple to insert this intermediate piece (box, adapter) between the head and the tip element, and this intermediate element can remain in position even when the novel hammer head-like adapter box is not needed.

The principal elements of the hammer head in accordance with the invention are the two traverses which are preferably construction as planar lattice element, for example, they may be constructed from welded together tubes. These traverses are mounted to opposite sides of the intermediate piece or box element, and extend at approximately right angles from the main boom, the angle being measured in relation to the longitudinal axis of the main boom. The rotatable mounting of the two traverses on the intermediate piece or box can in fact be folded along with the main boom, and remain in folded position even when the novel hammer head of this type is not needed. Whenever it is needed, the traverses are held in the outwardly extending position through the releasable tensioning elements, such as one or several cable or, preferably, tension rods.

As stated, one of the traverses is linked to the intermediate adapter piece adjacent the front side of the main boom, and the front end of that traverse carries the first deflection pulley or sheave for the lifting cable. Of course in those cases in which several lifting cables are provided one needs several sheaves or pulleys accordingly. The other traverse is attached to the rear end and has its front end attached the holding cable for the main boom. It can thus be seen that the hammer head of novel construction can be assembled or disassembled in relation to the crane in a very easy manner and in a short period of time. An existing tower crane does not require constructive modifications for attaching the new hammer head. The only aspect that is needed is that there must be bores for fastening the tension devices of the traverses to the head of the main boom.

In furtherance of the invention the existing construction of the hammer head should realize selectively two different distances for the axis of rotation of the first deflection sheave or pulley in relation to the longitudinal axis of the main boom. This concept can be realized by selecting the two traverses differently long and permitting their exchange on the adapter box, and this of course requires switching the deflection pulley and the connection to the holding cable for the main boom.

As stated, the pin connections for the traverse and the connections of the deflection sheave or pulley, as well as the connection for the holding cable, should all have similar dimensions. The length of the tensioning rods for the traverses should be adjustable so that the two traverses have a right angle in relation to the longitudinal axis of the main boom on the front as well as in the back of that boom. The inventive hammer head therefore offers the advantage of very low investment cost, and due to its small volume (because it can be folded against the main boom), and further owing to simple assembly and disassembly procesures involved, the stated objectives are indeed met.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Proceeding now to the detailed description of the drawings. FIG. 1 illustrates the main boom 6 of a latticed tower crane. This boom 6 is composed of individual lattice structures or sub-units of which the upper one is the tip element 1. The tip element 1 is coaxial with the head 2 of the main boom being arranged above. This tip element 1 and the head 2 are interconnected through the interposed intermediate adapter piece or element 4, the connection being made through pins or bolts 3*a* and 3*b*. Details of these connections are found in FIGS. 2 and 3.

Figure 2:
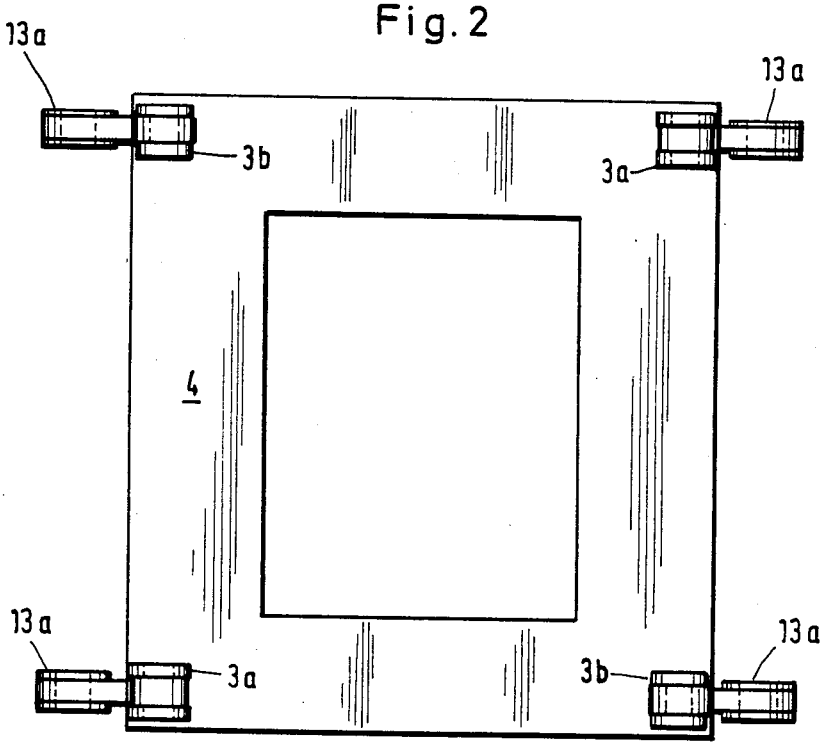
FIG. 2 is a top elevation of the intermediate piece forming the principal element of the inventive design.

The intermediate piece 4 is basically a flat box made of welded together steel plate or sheet, and having a high stiffness accordingly. Its cross section corresponds to the cross section of the tip element 1. The fastening elements 3*a* (double lugs) and 3*b* (single lugs), as pertaining to the intermediate piece or adapter box 4, correspond to similarly and matchingly constructed fastening elements at the upper end of the tip element 1, as well as those fastening elements provided at the lower end of the head 2. In other words, it is assumed that a certain mode of connection is provided to directly connect the head 2 to the tip element 1 through certain fastening elements like intermating lugs 3*a*, 3*b*. The intermediate piece 4 is provided for interpositioning, and has a corresponding set of fastening elements to permit immediate and a direct connection with the tip element 1 at one end, and the head 2 at the other end. The top view of the intermediate box 4 in FIG. 2 shows connector lugs 3*x* which actually pertains to head 2.

Figure 1:
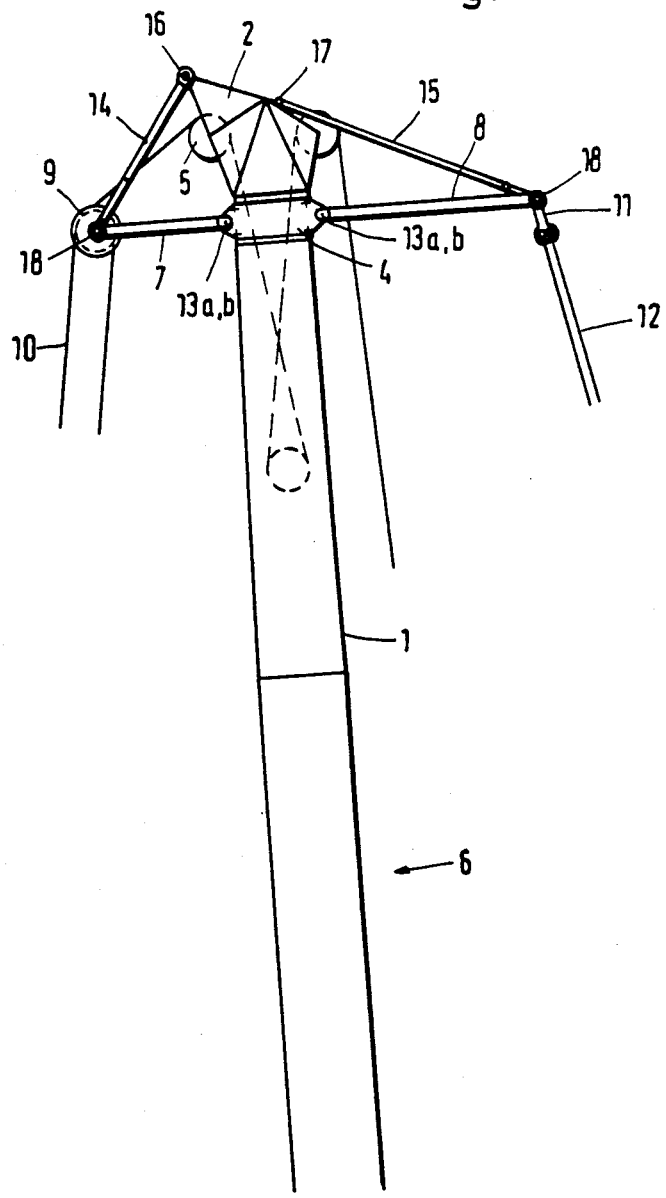
FIG. 1 is a side elevation of the main boom of a lattice type tower crane improved with a novel hammer head in accordance with the preferred embodiment of the present invention for practicing the best mode thereof.
Figure 3:
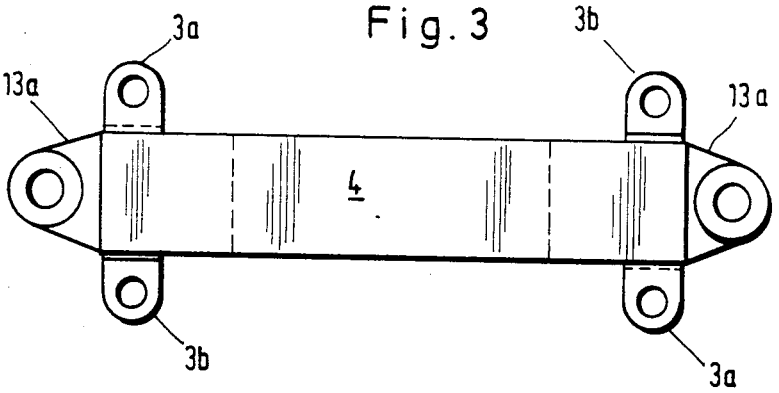
FIG. 3 is a side view of the intermediate piece shown in FIG. 2.
Figure 4:
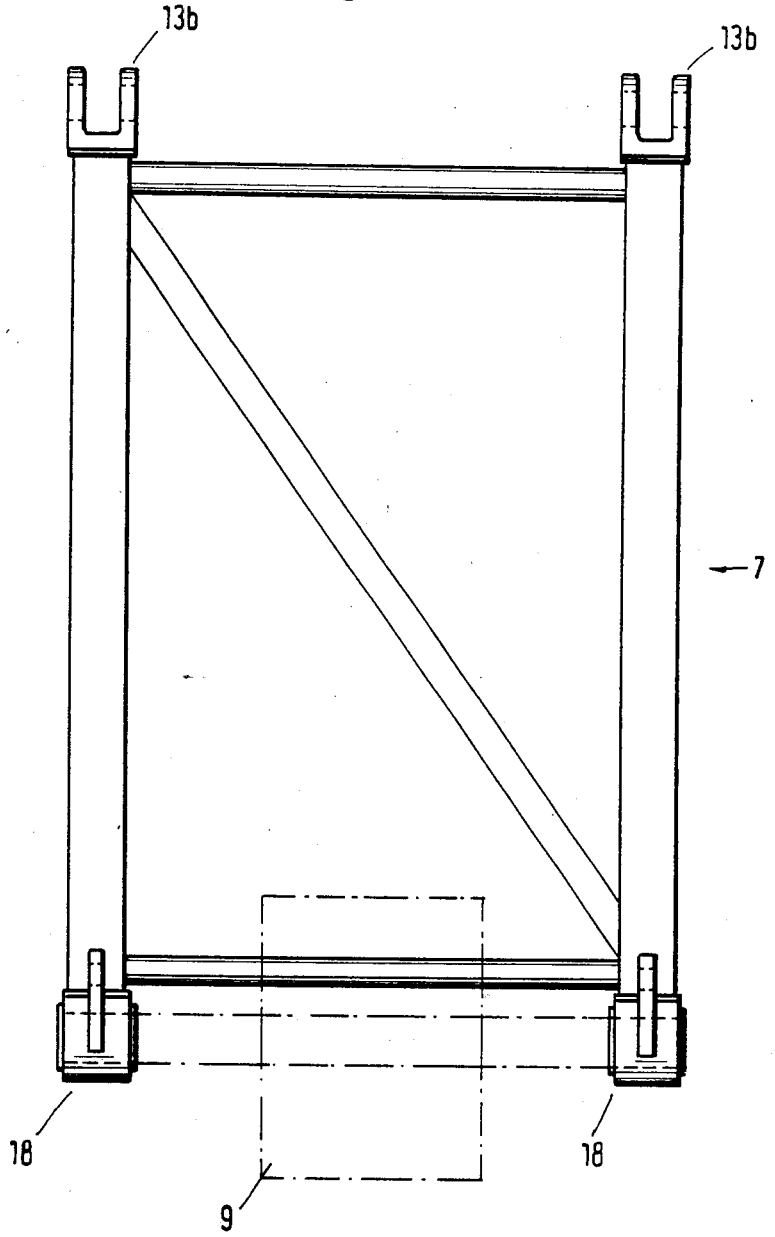
FIG. 4 is a top elevation of the front traverse as used in the equipment shown in FIGS. 1 and 2.

The front end of the intermediate piece 4 as seen from the point of view of the load is provided with a traverse 7. This traverse is depicted in greater detail in FIG. 4. Basically, the traverse is a planar lattice structure composed of interconnected steel tubes or pipes. The traverse is pivotably mounted on the box 4 under utilization of lugs 13*a* for obtaining pin connection. The fasteninig elements 13*a* are at the box 4. There are double lug-type fastening elements 13*b* on the traverse 7. The pivoting is provided for about an axis that runs transversely to the longitudinal axis of the boom 6. The traverse 7 of course extends at right angles from its pivot axis, and is deployed in FIG. 1 in a direction being at least approximately at right angles to the longitudinal axis of the boom 6.

Two tension rods interconnect the head 2 with the front end of the traverse 7. These tension rods 14 are releasably connected to the head, for example, through bolts or pins or any other suitable rapid action connection at points 16. The rods 14 are articulated through their respective other ends with the front end of the traverse 7.

A deflection pulley or sheave 9 for the load carrying cable 10 is journalled at the front end of the traverse 7. The load is suspended from the cable 10. The pulley or sheath 9 in particular is mounted on a shaft 9*a*, which is mounted by suitable bearings 18 at the end outer points of the traverse 7.

Figure 5:
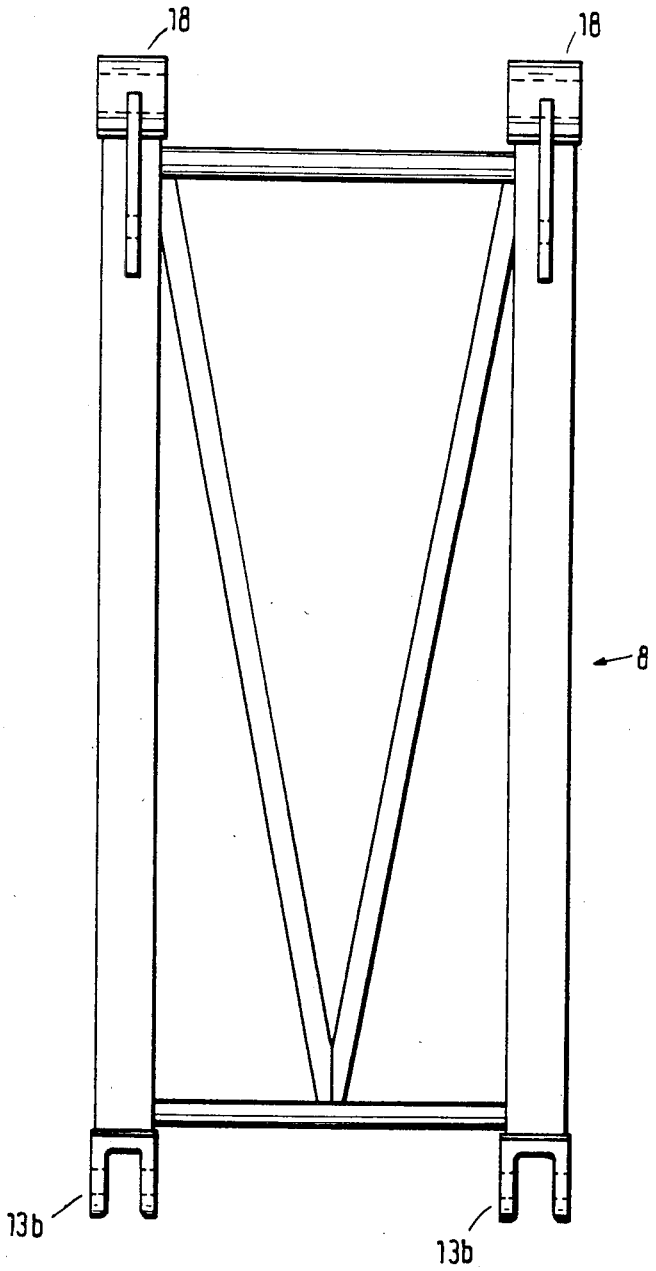
FIG. 5 is a corresponding top elevation of the rear traverse used in the aforementioned equipment.

A second traverse 8 is provided on box or intermediate piece 4 opposite the connection to the traverse 7. The connection is similar in both instances, i.e., the box 4 has a second set 13*a* of lugs for pin connections, and, as shown in FIG. 5, there is a corresponding set or double lugs 13*b* for the pin connections to obtain a hinge linkage on the box 4 mounting the one end of the traverse 8.

It is important that all these connections 13*a* and 13*b*, respectively, have similar dimensions for purposes of ease of adaption, mounting and assembly. This second traverse 8 is therefore likewise pivotable about an axis that runs transversely to the axis of the main boom 6 which is perpendicular to the plane of the drawing of FIG. 1, and runs parallel to the axis by means of which the traverse 7 is mounted to the box 4.

The traverse 8 is likewise constructed as a planar lattice construction under utilization of welded together steel pipes. In position, the traverse 8 is likewise deployed to extend approximately at right angles to the axis of the main boom 6, and of course that direction of extension is perpendicular to the pivot axis. Essentially then the two traverses 7 and 8 extend in opposite directions and in a near parallel configuration. The traverse 8 is at its front end connected to tension rods 15, having a releasable pin, bolt or screw connection at 17 for connection to the main head 2. Therefore, the tension rods 15 hold the traverse 8 in the illustrated position.

The outer, unhinged end of the traverse 8 is provided with a linking point 11 for holding cable 12, by means of which the main boom 6 is held in position and tensioned. The receiving elements 18 or bearings for the linking 11, as well as for the respective fastening for the deflection sheath or pulley 9, are likewise provided with similar dimensions to establish interchangeability. The length of the traverse 8 is roughly twice that of the traverse 7. Moreover, the length of the tension rods 14 and 15 could be made subject to change by providing each of these tension rods in a biparted telescopic kind of connection permitting length adjustment through connection and fastening.

It can thus be seen that the traverses 7 and 8 are easily exchangeable in position vis-a-vis the box 4, and the deflection pulley or sheave 9 on one hand, and the linkage 11 on the other hand, are likewise exchangeable with regard to their connection to either of the traverses. In spite of such exchange, their respective perpendicular orientation vis-a-vis the longitudinal axis of the boom under matching of the links or exchanging the tension rods remains invariant. Therefore, the inventive construction realizes a type of hammer head at the main boom by means of which two different distances can be selected as far as the spacing of the axis of deflection sheave or pulley 9 from the longitudinal axis of the main boom 6 is concerned without requiring any additional construction elements.

Whenever the hammer head is not needed, the rods 14 and 15 are simply removed, which is the purpose of providing easily releasable connections, and the traverses 7 and 8 will be simply folded against the main boom 1. In such a case, the holding cable 12 will be connected to the appropriate fastening point at the main head 2. Suitable fastening points for this purpose are provided anyway at that head 2. On the other hand, the load carrying cable 10 will be, as seen from the load, run first over the deflection sheave or pulley 5 of the main head 2, but the guiding of the cable 10 remains invariant for the various modes of operation. Thus, the interpositioning of this box element 4 will not interfere with "normal" operation of the boom.

Considering the objectives of the invention stated above, it can readily be seen that the inventive modification for a tower crane permits bulky load to be lifted to the desired height or level without requiring any noticeable extension of the main boom 6. Of course one could say that the box 4 provides an extension, be it ever so a slight one, however, as has been just mentioned, the box 4 can remain as a permanent installation, even when not used, so that from that point of view a changeover from normal load carrying to bulky load carrying will not entail an extension of the main boom. Whenever the novel hammer head is used, it is merely necessary to deploy the traverses 7 and 8 and fastening them through tension rods 14 and 15 as described, and the structures 11 and 18 can be then added without posing any problem. These are simple assembly steps.

It can thus be seen that on the other hand the hammer head as proposed is characterized by a kind of universal utility which is of a particular advantage. This means that the hammer head 4 with attachments can be affixed to any existing crane provided the respective head, such as 2, is disconnectable from the respective tip element, such as 1, which is normally the case. The only adaptation that is needed is an adaptation to the existing fastening structure by means of which such a main head is connected to the respective tip element.

The preferred embodiment of the invention, the objects and features of the invention, and further objects, features and advantages thereof, will be better understood from the following description taken in connection with the accompanying drawings.

I claim:

1. In a lattice tower crane having a main boom, the boom having a tip element, there being a removable head for a deflection pulley, for the main boom, the combination comprising:

a flat boxlike intermediate element of high stiffness and matching in cross section a cross section of said tip element;

fastening means on the flat element respectively corresponding to fastening elements on the head and on the tip element by means of which the head and the tip element can be interconnected directly, for respective connection to the head and to the tip element to thereby being interposed between them;

a first traverse hinged on said flat intermediate element for pivoting about an axis transversely to the axis of said main boom;

a deflection pulley or sheave journalled on the unhinged end of said first traverse;

a second traverse hinged to said flat intermediate element about an axis transversely to the axis of said main boom and for extending in about a direction opposite a direction of extension of the first traverse;

means at the unhinged end of said second traverse for connection to holding a cable for the main boom; and releasable tensioning means for connecting the respective unhinged ends of said first and second traverse to said head for holding the traverses in a deployed position, release of the tensioning means permitting holding of the traverses against the boom.

2. Tower crane as in claim 1, said traverses being constructed as planar lattice type construction elements.

3. Tower crane as in claim 2, said first and second traverse being hingedly connected to said flat intermediate element through pin connections.

4. Lattice tower crane as in claim 1, said tensioning means being tension rods.

5. Lattice tower crane as in claim 1, said traverses being of different lengths, said hinge means being provided for exchanging the positions of the traverse connections to said flat boxlike elements.

6. Lattice tower crane as in claim 5, said deflection pulley or sheave, and said means for the holding cable being exchangeable on the two traverses.

* * * * *